US005806729A

United States Patent [19]

Ramon

[11] Patent Number: 5,806,729

[45] Date of Patent: Sep. 15, 1998

[54] COLLAPSIBLE BOOTJACK FOR PUTTING ON AND REMOVING BOOTS

[76] Inventor: Juan C. Ramon, 3514 Manitou Dr., Houston, Tex. 77013

[21] Appl. No.: 931,610

[22] Filed: Sep. 16, 1997

[51] Int. Cl.[6] ..... A47G 25/80

[52] U.S. Cl. ..... 223/115; 223/114; 223/113

[58] Field of Search ..... 223/115, 114, 223/113, 111, 120

[56] References Cited

U.S. PATENT DOCUMENTS

| | | | |
|---|---|---|---|
| 28,927 | 6/1860 | Wheeler | 223/114 |
| 1,748,643 | 2/1930 | Folsom | 223/115 |
| 2,571,447 | 10/1951 | Hilton | 223/115 |
| 4,262,828 | 4/1981 | Kosakai | 223/115 |
| 5,516,015 | 5/1996 | Berzins et al. | 223/115 |

*Primary Examiner*—Bibhu Mohanty
*Attorney, Agent, or Firm*—Kenneth A. Roddy

[57] ABSTRACT

A collapsible bootjack for use in both putting on and removing boots having boot straps. The bootjack has a base member for supporting it on a flat surface and an elongate platform pivotally connected at a rear end to the base member with a generally V-shaped opening at its front end for receiving the heel of a boot. A pair of laterally spaced boot strap receiving elements disposed one at each side of the V-shaped opening extend forwardly from the front end for receiving the boot straps of a boot. The platform is movable to an upright erected position wherein the boot strap receiving elements are disposed in a generally horizontal position for receiving the boot straps and suspending the boot therefrom to allow a user to insert their foot into the suspended boot, and to a collapsed position wherein the platform is disposed on an inclined plane relative to the flat support surface with the generally V-shaped opening facing forward to allow a user to place one foot on the platform and engage the heel portion of a boot being worn on their other foot in the generally V-shaped opening and withdraw their foot from the engaged boot.

14 Claims, 6 Drawing Sheets

COLLAPSIBLE BOOTJACK FOR PUTTING ON AND REMOVING BOOTS

BACKGROUND OF THE INVENTION

1. Field of the Invention

This invention relates generally to bootjacks, and more particularly to a collapsible bootjack which is used for putting on and removing boots.

2. Brief Description of the Prior Art

Because western boots or "cowboy boots" have a long narrow barrel or upper portion, the wearer often has a difficult time inserting his or her foot into the boot when putting them on and also when removing them.

Bootjacks are commonly used to remove boots. A popular conventional bootjack consists of a flat platform supported on an incline that has a U-shaped or V-shaped recess at one end. The user places one foot on the inclined platform and engages the lower rear portion of the other boot in the recess and withdraws the foot from the engaged boot.

There are several patents which disclose various bootjacks.

Tarner, U.S. Pat. No. 4,226,346 discloses a compact foldable bootjack having a hinged platform formed of a front and rear member pivotally connected together and supported on an incline by a hinged leg member. The front member has a V-shaped recess at its outer end which receives and holds the lower rear portion of the boot while the user withdraws their foot from the boot. The bootjack can be folded into a compact configuration.

McCormick, U.S. Pat. No. 4,394,946 discloses a collapsible bootjack having a hinged base with an upstanding link and horizontally disposed U-shaped yoke pivotally connected together. In the erected position, the U-shaped yoke receives and holds the lower rear portion of the boot while the user withdraws their foot from the boot. The yoke and link may be pivoted to a common plane and pivoted as a unit to underlie the base when not in use.

Berzins et al, U.S. Pat. No. 5,516,015 discloses a foldable bootjack having a hinged platform formed of a first and second boot engaging member and a leg member connected together by a hinge pin and supported on an incline by the leg member. The first boot engaging member has a U-shaped recess at its outer end and the second boot engaging member has a U-shaped recess of a different size at its outer end for receiving and holding boots of different sizes. The bootjack may be positioned on an incline to elevate the first or second boot engaging member which then receives and holds the lower rear portion of the boot while the user withdraws their foot from the boot. The bootjack can be folded into a compact configuration.

Although the above described bootjacks are capable of removing boots, they do not address the problem of putting the boots on.

The present invention is distinguished over the prior art in general, and these patents in particular by a collapsible bootjack for use in both putting on and removing boots having boot straps. The bootjack has a base member for supporting it on a flat surface and an elongate platform pivotally connected at a rear end to the base member with a generally V-shaped opening at its front end for receiving the heel of a boot. A pair of laterally spaced boot strap receiving elements disposed one at each side of the V-shaped opening extend forwardly from the front end for receiving the boot straps of a boot. The platform is movable to an upright erected position wherein the boot strap receiving elements are disposed in a generally horizontal position for receiving the boot straps and suspending the boot therefrom to allow a user to insert their foot into the suspended boot, and to a collapsed position wherein the platform is disposed on an inclined plane relative to the flat support surface with the generally V-shaped opening facing forward to allow a user to place one foot on the platform and engage the heel portion of a boot being worn on their other foot in the generally V-shaped opening and withdraw their foot from the engaged boot.

SUMMARY OF THE INVENTION

It is therefore an object of the present invention to provide a bootjack which can be used for putting on and removing boots.

It is another object of this invention to provide a collapsible bootjack which may be deployed to an erected position for use in putting on boots or to a collapsed position for use in removing boots.

Another object of this invention is to provide a collapsible bootjack which will allow a user to easily and quickly put on and remove a pair of boots.

Another object of this invention is to provide a collapsible bootjack which may be easily and quickly collapsed to a compact configuration for storage.

Another object of this invention is to provide a collapsible bootjack which allows the user to put on and remove boots in a comfortable standing position.

A further object of this invention is to provide a collapsible bootjack which will prevent damage to leather boots.

A still further object of this invention is to provide a collapsible bootjack which simple in construction, inexpensive to manufacture, and rugged and reliable in operation.

Other objects of the invention will become apparent from time to time throughout the specification and claims as hereinafter related.

The above noted objects and other objects of the invention are accomplished by a collapsible bootjack for use in both putting on and removing boots having boot straps. The bootjack has a base member for supporting it on a flat surface and an elongate platform pivotally connected at a rear end to the base member with a generally V-shaped opening at its front end for receiving the heel of a boot. A pair of laterally spaced boot strap receiving elements disposed one at each side of the V-shaped opening extend forwardly from the front end for receiving the boot straps of a boot. The platform is movable to an upright erected position wherein the boot strap receiving elements are disposed in a generally horizontal position for receiving the boot straps and suspending the boot therefrom to allow a user to insert their foot into the suspended boot, and to a collapsed position wherein the platform is disposed on an inclined plane relative to the flat support surface with the generally V-shaped opening facing forward to allow a user to place one foot on the platform and engage the heel portion of a boot being worn on their other foot in the generally V-shaped opening and withdraw their foot from the engaged boot.

DESCRIPTION OF THE PREFERRED EMBODIMENT

Figure 1:
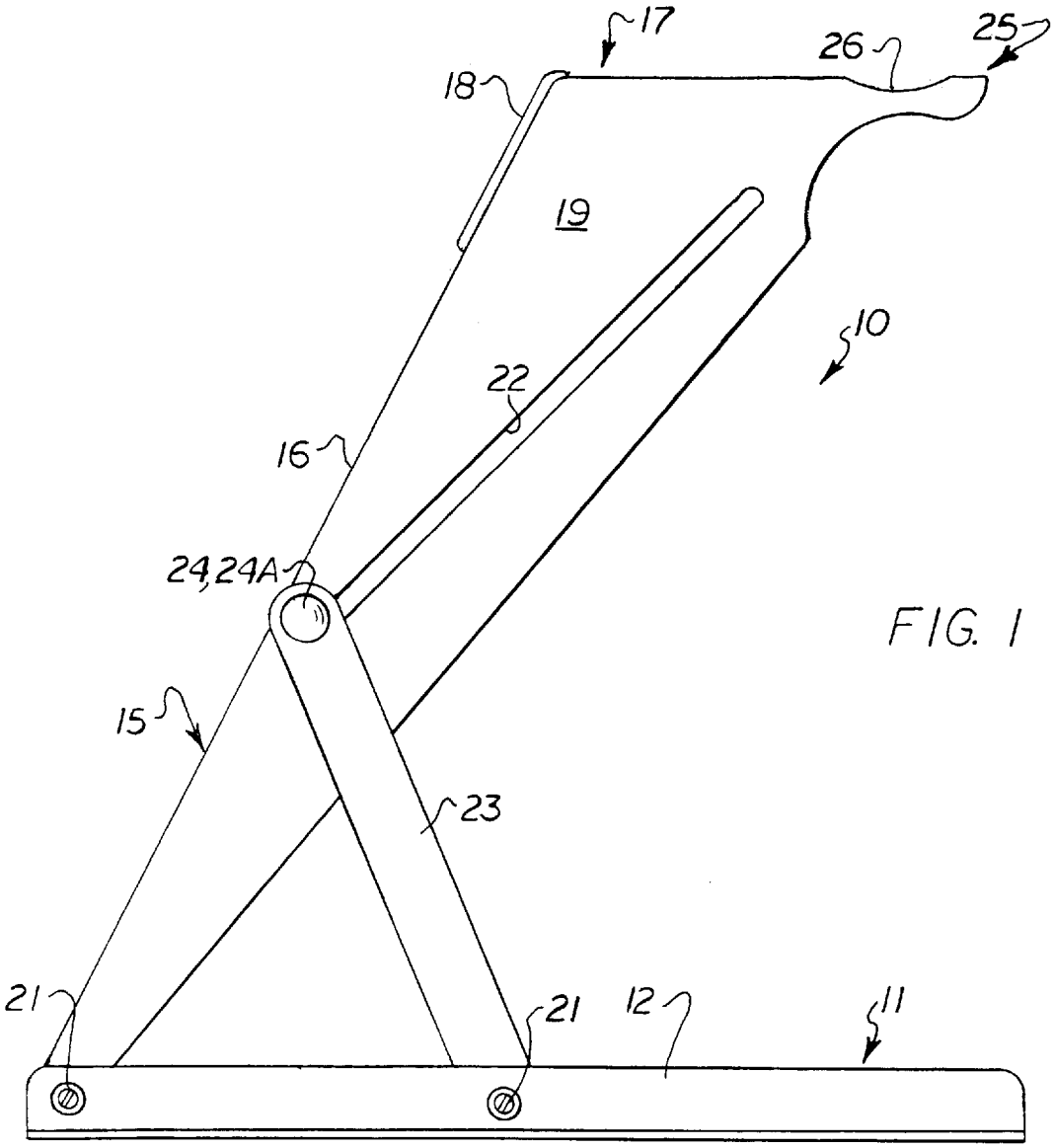
FIG. 1 is a side elevation of the collapsible bootjack apparatus in accordance with the present invention shown in an erected position for use in putting on a boot.
Figure 2:
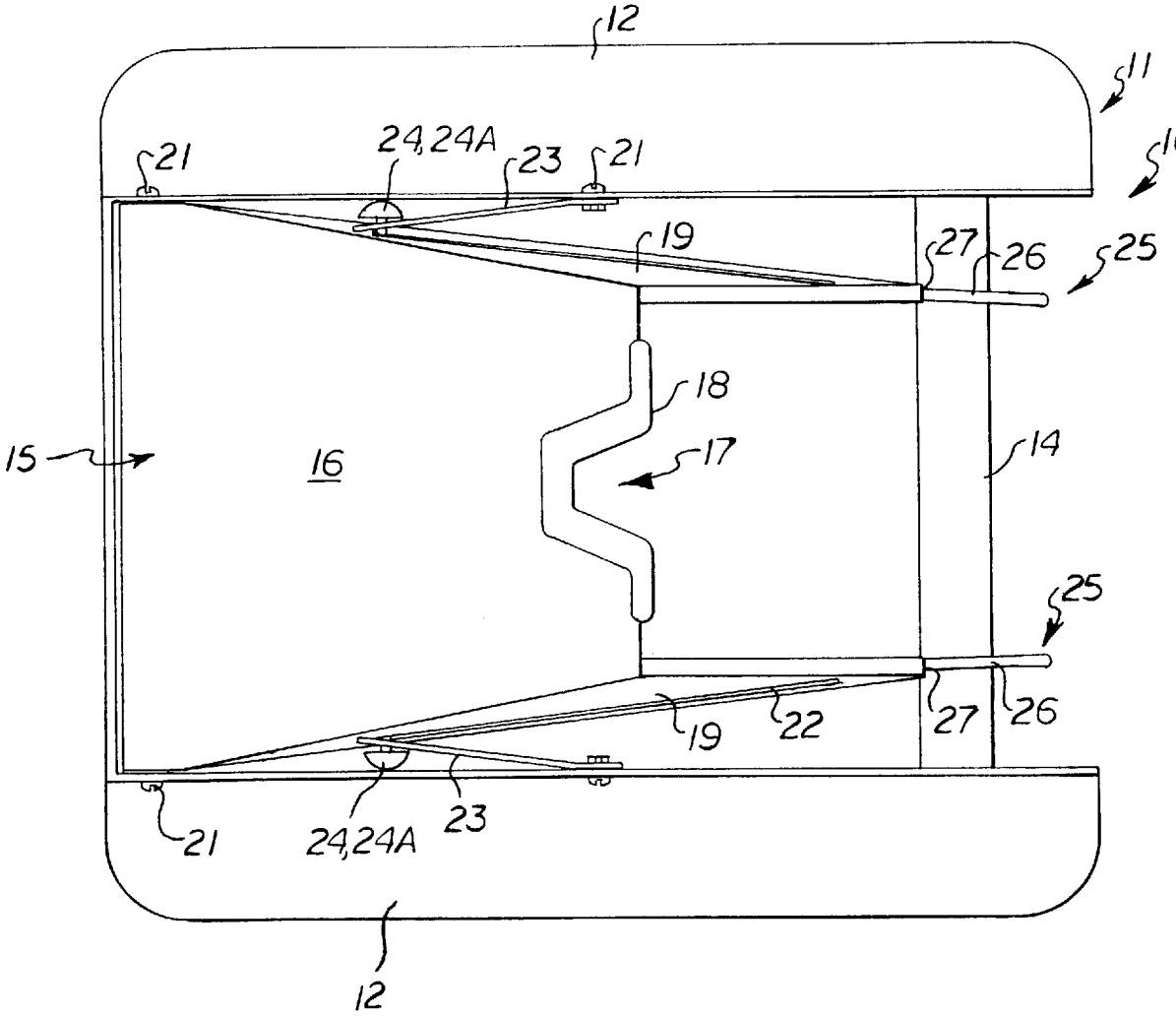
FIG. 2 is a top plan view of the collapsible bootjack apparatus shown in the erected position.
Figure 3:
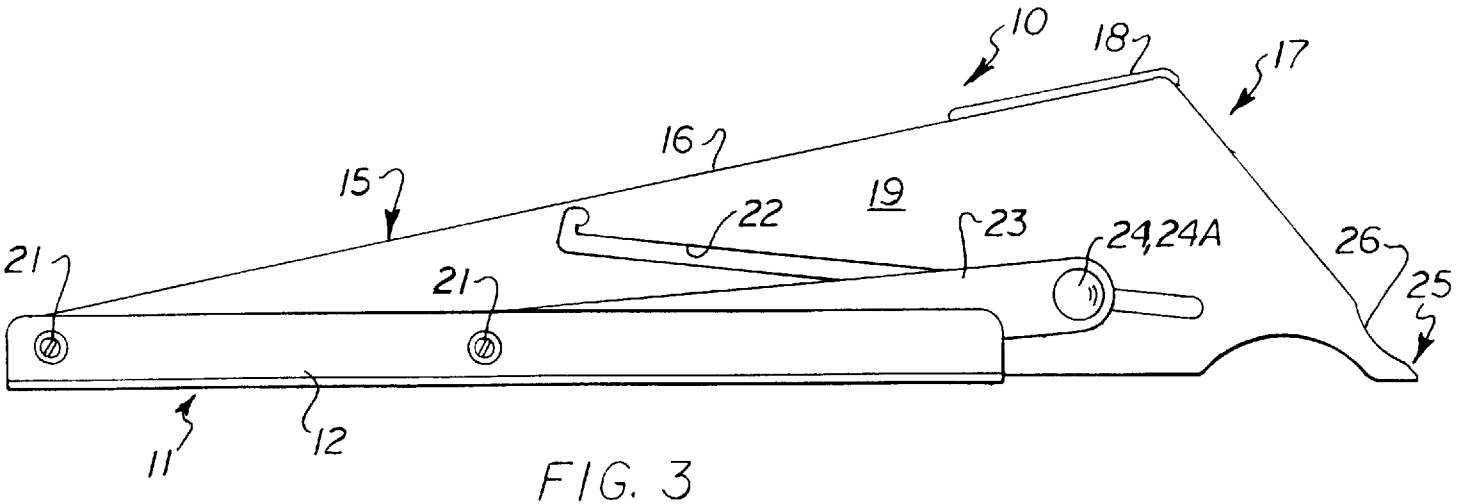
FIG. 3 is a side elevation of the collapsible bootjack apparatus shown in a collapsed position for use in removing a boot.
Figure 4:
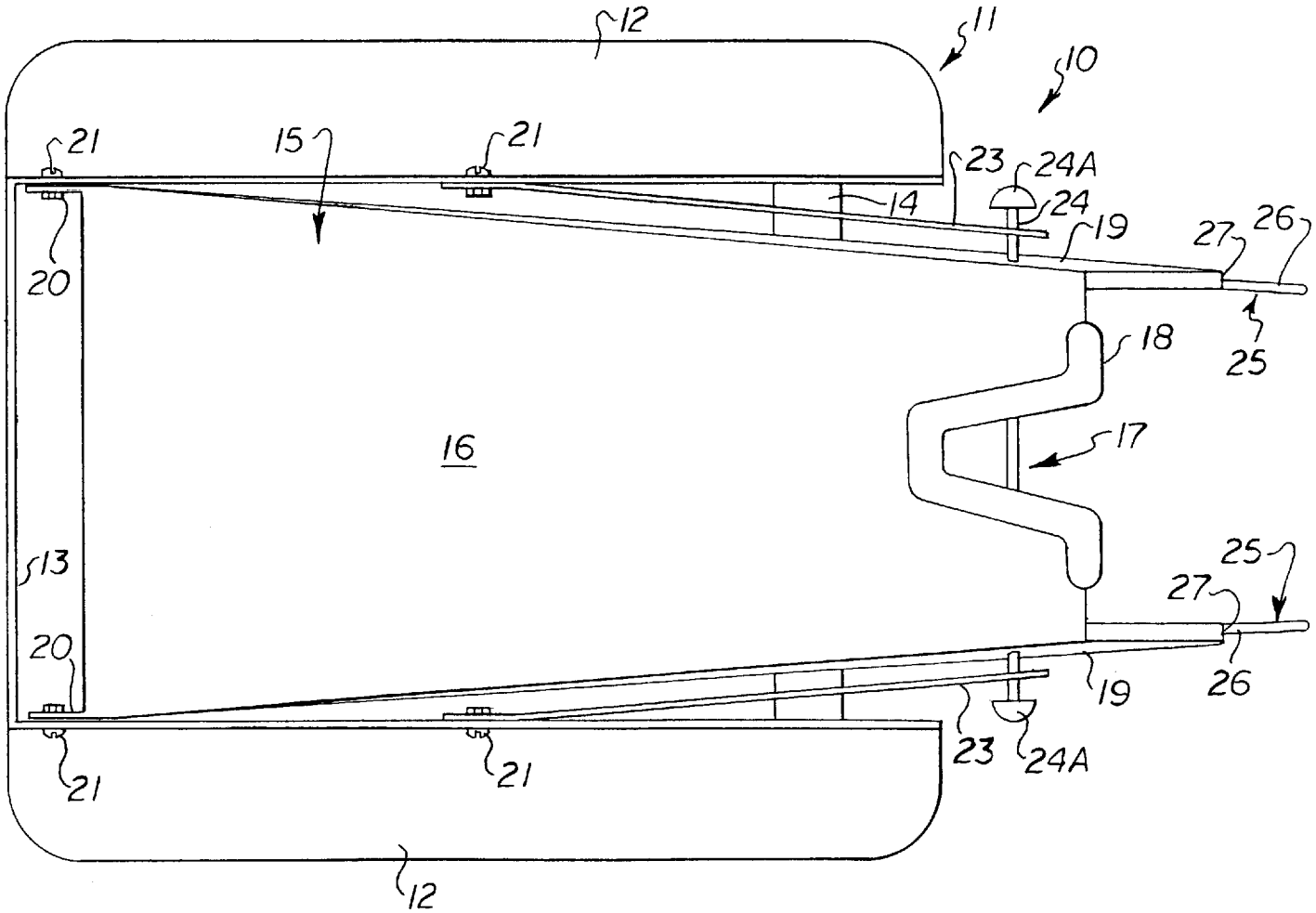
FIG. 4 is a top plan view of the collapsible bootjack apparatus shown in the collapsed position.

Referring to the drawings by numerals of reference, there is shown in FIGS. 1 and 2, a preferred collapsible bootjack apparatus 10 in accordance with the present invention shown in an erected position for use in putting on a boot. FIGS. 3 and 4 show the collapsible bootjack apparatus 10 in a collapsed position for use in removing a boot.

The bootjack 10 has a base 11 formed of a pair of L-shaped angle members 12 secured together in laterally opposed spaced relation by a transverse rectangular crossmember 13 at one end and another transverse rectangular crossmember 14 near their opposed end.

A platform 15 is pivotally connected at one end between the angle members 12. The platform 15 has an elongate planar footrest portion 16 which is wider at a first or rear end and tapers to a narrower second or front end to form a somewhat trapezoidal configuration. A generally V-shaped opening 17 is formed in the front end of the footrest portion 16. A generally V-shaped pad 18 formed of soft elastomeric, leather or other suitable material is secured to the footrest and surrounds the inner surfaces of the V-shaped opening 17.

A pair of flat side panels 19 extend downwardly and slightly outwardly from the opposed side edges of the footrest portion 16. Each side panel 19 tapers from a shorter first or rear end to a longer second or front end end to form a somewhat trapezoidal configuration. As best seen on FIG. 4, the rear ends of the side panels 19 extend a short distance beyond the rear end of the footrest portion 16 to form a pair of ears 20 which are pivotally connected to the upstanding leg portion of the angle members 12 by pivot pins 21 secured through aligned holes formed in the ears and upstanding leg portions.

An elongate J-slot 22 is formed in each side panel 19. A pair of link members 23, one at each side of the platform, are each pivotally connected at one end to the upstanding leg portion of each angle member 12 by pivot pins 21 secured through aligned holes formed in the link member ends and upstanding leg portions. A rod 24 extends transversely along the underside of the footrest portion 12 of the platform 11 with its outer ends passing through the J-slots 22 in the side panels 19. End caps 24A are secured on the opposed ends of the rod 24 to prevent removal.

The longer front ends of the side panels 19 extend angularly outward from the front end of the footrest portion 16 at each side of the V-shaped opening 17. The outermost portion of the top edge of the front ends of the side panels 19 are contoured to define laterally opposed boot-receiving elements 25. In a preferred embodiment, the top edges are contoured to form a rounded edge with a shallow concave portion 26 and a wider portion reawardly therefrom to define a stop shoulder 27. The purpose of the boot receiving elements 25 is to receive the boot straps of a boot and thereby suspend the boot when the platform 11 is in the erected position (FIGS. 1 and 2), and also to serve as support legs for supporting the platform when it is in the collapsed position (FIGS. 3 and 4).

OPERATION

Figure 5:
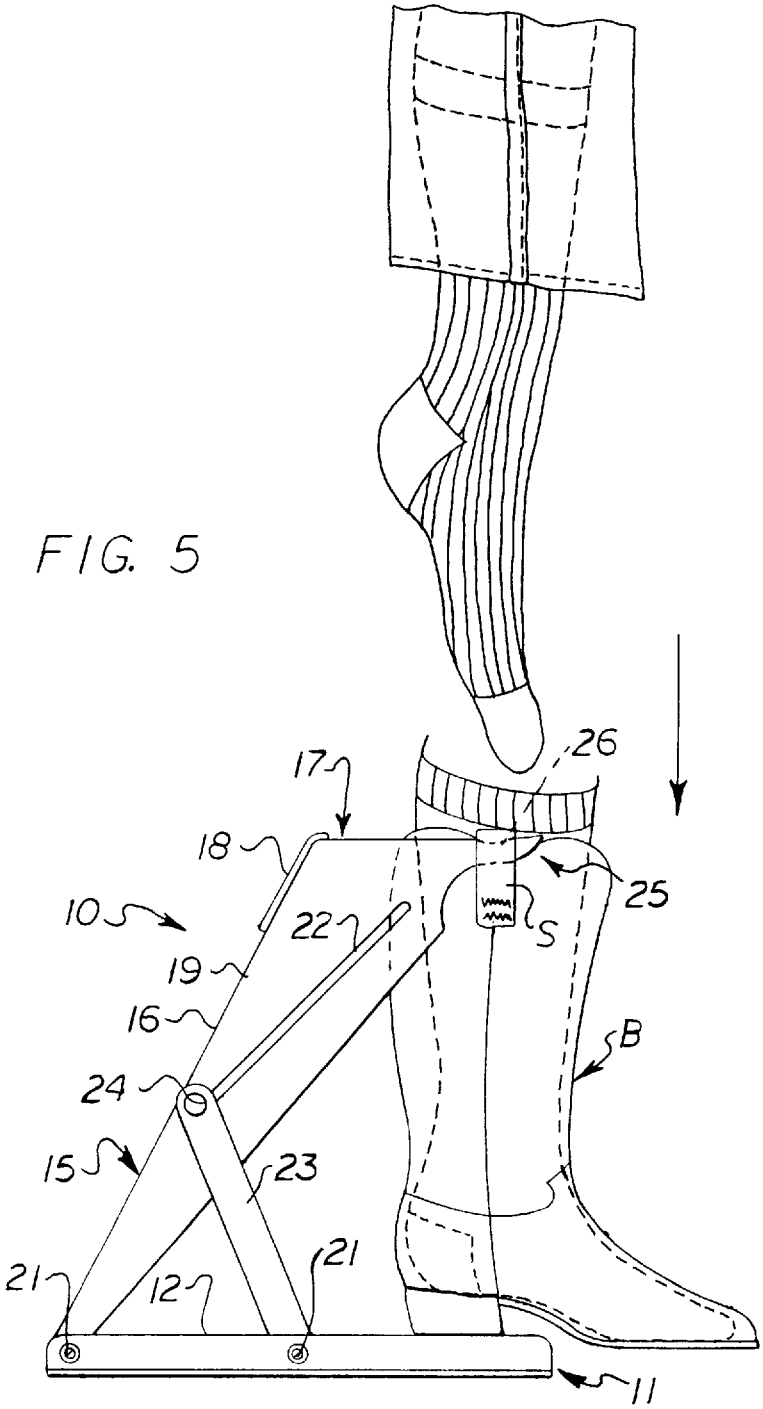
FIG. 5 is a side elevation of the collapsible bootjack apparatus in the erected position showing a user inserting their foot into a boot supported on the bootjack.

Referring now to FIG. 5, to use the collapsible bootjack 10 for putting on boots, the platform 15 is raised to an upright or erected position (FIGS. 1 and 2). When the platform 15 is raised, the transverse rod 24 slides along the J-slots 22 in the side panels 19 and enters the hook portion of the J-slot to maintain the platform in the erected position.

The boot straps S at each side of the upper end of the barrel or upper portion of a boot B are placed on the concave portion 26 of the boot strap receiving elements 25. In this position the boot B is suspended a short distance above the floor and the upper end of the barrel or upper portion of the boot is maintained in a wide open position by the boot strap receiving elements 25. The user then points their toes downward and inserts his or her foot downwardly through the barrel or upper portion of the boot and into the toe portion until their heel fits into the heel portion of the boot. After the foot is received in the boot B, the wearer then moves his or her leg forward to remove the boot straps S from the boot strap receiving elements 25.

Figure 6:
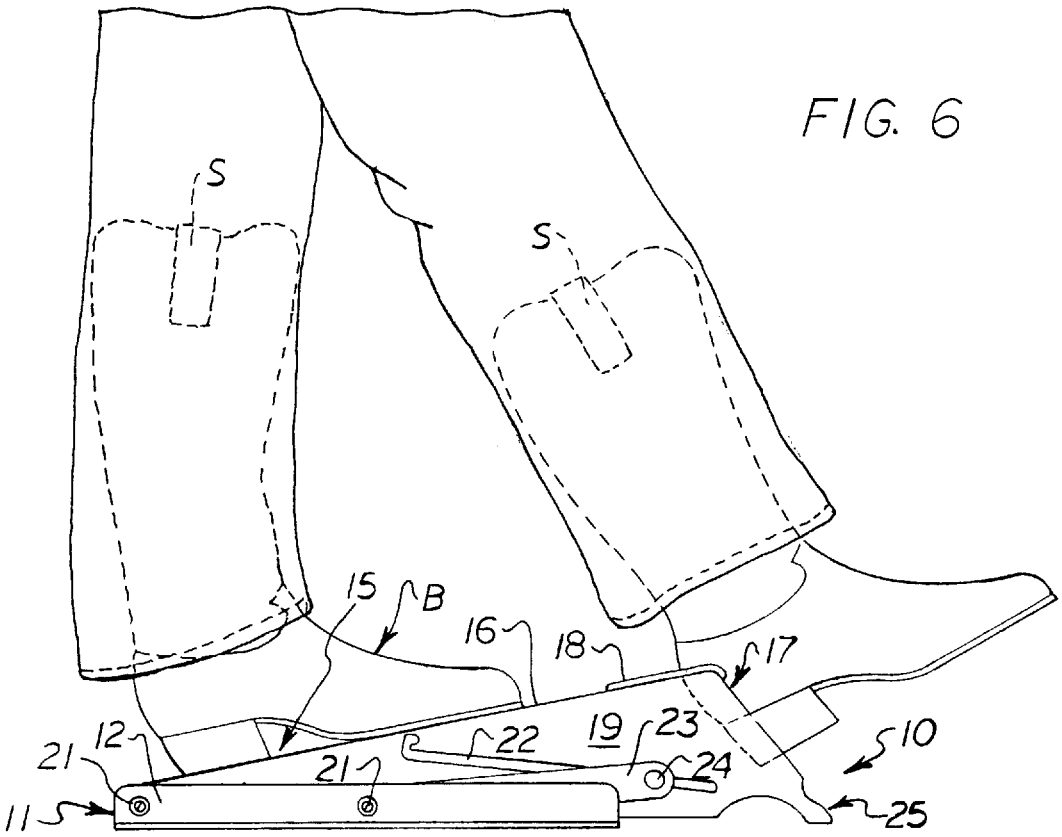
FIG. 6 is a side elevation of the collapsible bootjack apparatus in the collapsed position showing a user withdrawing their foot from a boot engaged on the bootjack.

Referring now to FIG. 6, to use the collapsible bootjack 10 for removing boots, the front end of the platform 15 is raised slightly to disengage the rod 24 from the hooked portion of the J-slots 22 and then lowered to the collapsed position (FIGS. 3 and 4). When the platform 11 is lowered, the transverse rod 24 slides along the straight portion of the J-slots 22 in the side panels 19. In the lowered position, the boot strap receiving elements 25 engage the floor surface and support the footrest portion 16 of the platform 15 on an inclined plane relative to the floor surface, with its V-shaped opening 17 facing forward.

The user then places one foot on the inclined footrest portion 16 to hold the bootjack 10 in place on the floor surface and engages the lower rear portion of the other boot B in the padded V-shaped opening 17 and withdraws their foot from the engaged boot.

It should also be noted that in the collapsed position (FIGS. 3 and 6), the bootjack forms a compact unit and may be conveniently stored beneath a bed or in a closet.

While this invention has been described fully and completely with special emphasis upon a preferred embodiment, it should be understood that within the scope of the appended claims the invention may be practiced otherwise than as specifically described herein.

I claim:

1. A collapsible bootjack for use in putting on and removing boots having boot straps:

a base member for supporting the bootjack on a flat surface;

an elongate platform having a first end pivotally connected to said base member and an opposed second end having a generally V-shaped opening for receiving a rear heel portion of a boot; and a pair of laterally spaced boot strap receiving elements disposed one at each side of said platform second end and extending outwardly therefrom for receiving the boot straps of a boot;

said platform being movable to an upright erected position wherein said boot strap receiving members are disposed in a generally horizontal position for receiving said boot straps and suspending said boot therefrom to allow a user to insert their foot into the suspended boot, and to a collapsed position wherein said platform is disposed on an inclined plane relative to said flat surface with said generally V-shaped opening facing forward to allow a user to place one foot on said platform and engage the rear heel portion of a boot being worn on their other foot in said generally V-shaped opening and withdraw their foot from the engaged boot.

2. The collapsible bootjack according to claim 1, wherein each said boot receiving element is sized and shaped to be disposed in a generally horizontal position when said platform is in said erected upright position for supporting said boot straps and suspending said boot therefrom; and to be disposed in an angularly downward position when said platform is in said collapsed position to engage said flat surface and function as support legs to support said platform on an inclined plane relative to said flat surface.

3. The collapsible bootjack according to claim 1, further comprising a pair of side panels extending downwardly from opposed side edges of said platform;

an elongate J-slot formed in each said side panel; and a pair of link members, one at each side of said platform, each pivotally connected at one end to said base member and slidably engaged with said J-slot at a second end to allow said platform to be moved between said collapsed position and said upright erected position and to become releasably engaged in a hooked portion of said J-slot to releasably maintain said platform in said upright erected position.

4. The collapsible bootjack according to claim 1, further comprising a generally V-shaped pad of soft material secured to said platform surrounding inner surfaces of said V-shaped opening.

5. The collapsible bootjack according to claim 1, wherein said platform first end is wider than said opposed second end to form a generally trapezoidal footrest portion on a top surface thereof.

6. The collapsible bootjack according to claim 1, wherein said base member comprises a pair of L-shaped angle members secured together in laterally opposed spaced relation by a first rectangular crossmember extending transversely between one end of each angle member and a second rectangular crossmember extending transversely near their opposed ends.

7. The collapsible bootjack according to claim 6, wherein said platform has a pair of flat side panels extending downwardly and slightly outwardly from opposed side edges, and each said side panel tapers from a shorter first end to a longer second end to form a generally trapezoidal configuration.

8. The collapsible bootjack according to claim 7, wherein said first ends of each said flat side panel extends a short distance beyond said platform first end to define a pair of laterally opposed ears that are pivotally connected to an upstanding leg portion of said L-shaped angle members.

9. The collapsible bootjack according to claim 7, further comprising an elongate J-slot formed in each said side panel; and a pair of link members, one at each side of said platform, each pivotally connected at one end to an upstanding leg portion of said L-shaped angle members and slidably engaged with said J-slot at a second end to allow said platform to be moved between said collapsed position and said upright erected position and to become releasably engaged in a hooked portion of said J-slot to releasably maintain said platform in said upright erected position.

10. The collapsible bootjack according to claim 9, wherein said link members are slidably engaged in said J-slot in each said side panel by a rod extending transversely between said side panels and having opposed outer ends passing through said J-slots and through said second end of each said link member.

11. The collapsible bootjack according to claim 1, wherein each said boot receiving element has a rounded top edge to receive said boot straps.

12. The collapsible bootjack according to claim 1, wherein each said boot receiving element has a rounded top edge and a shallow concave portion to receive said boot straps.

13. The collapsible bootjack according to claim 1, wherein each said boot receiving element has a rounded top edge, a shallow concave portion to receive said boot straps, and a stop shoulder spaced from said concave portion.

14. A method for assisting a person in putting on and removing boots having boot straps, comprising the steps of:

providing a portable collapsible bootjack having an elongate platform pivotally connected at a first end to a base member, a generally V-shaped opening at an opposed second end for receiving a rear heel portion of a boot, and a pair of laterally spaced boot strap receiving elements disposed one at each side of said platform second end and extending outwardly therefrom for receiving the boot straps of a boot;

placing said bootjack base member on a flat surface;

moving said platform to an upright erected position wherein said boot strap receiving members are disposed in a generally horizontal position, placing the boot straps of an empty boot on said boot strap receiving elements to suspend said empty boot therefrom, inserting the foot of the person into the suspended boot, and thereafter moving the boot installed on the foot to remove the boot straps from said boot strap receiving elements; and moving said platform to a collapsed position wherein said platform is disposed on an inclined plane relative to said flat surface with said generally V-shaped opening facing forward, placing one foot of the person on said platform, engaging the rear heel of a boot being worn on the the persons other foot in said generally V-shaped opening, and withdrawing the persons foot from the engaged boot.

* * * * *